United States Patent [19]

Reed et al.

[11] Patent Number: 5,007,650

[45] Date of Patent: Apr. 16, 1991

[54] METHOD OF PLAYING A BOARD GAME OF COLLEGE SOCIAL LIFE

[76] Inventors: Keith Reed, 2211 Sweetbriar Rd., Morrisville, Pa. 18067; Keith Coleman, 25 Spinythorn Rd., Levittown, Pa. 19506

[21] Appl. No.: 410,428

[22] Filed: Sep. 21, 1989

[51] Int. Cl.[5] ..... A63F 3/00

[52] U.S. Cl. ..... 273/249; 273/459; 273/440

[58] Field of Search ..... 273/243, 249, 250–254, 273/1 G, 1 R

[56] References Cited

U.S. PATENT DOCUMENTS

| | | | |
|---|---|---|---|
| 1,569,945 | 1/1926 | Brittingham | 273/1 G |
| 3,722,885 | 3/1973 | Leaf | 273/1 G |
| 4,040,628 | 8/1977 | Pope | 273/243 |
| 4,121,823 | 10/1978 | McBride | 273/244 |
| 4,216,966 | 8/1980 | MacRae | 273/243 |
| 4,315,628 | 2/1982 | Balash et al. | 273/296 |
| 4,344,625 | 8/1982 | Frudakis | 273/242 |

FOREIGN PATENT DOCUMENTS

| | | | |
|---|---|---|---|
| 2198361 | 6/1988 | United Kingdom | 273/249 |

*Primary Examiner*—Benjamin Layno

*Attorney, Agent, or Firm*—Richard C. Litman

[57] ABSTRACT

A board game representing the lighter, non academic aspects of college or university life is disclosed. The game incorporates various activities commonly perceived to be engaged in by college or university students, including physical interaction between players of opposite sexes and social drinking, although such drinking is not necessarily limited to alcoholic beverages during the play of the game. The game is played on a generally peripheral path on the game board, the path containing various instructions relating to social drinking and/or physical interaction between players or teams of opposite sexes, or the drawing of cards containing such instructions. The completion of a lap of the playing path represents the completion of some academic period such as a school year, the winner determined as the first player or team to complete a predetermined number of laps of the playing path. Alternatively, the player or team farthest ahead at the end of a given elapsed time may be declared the winner.

4 Claims, 3 Drawing Sheets

You can't curse!

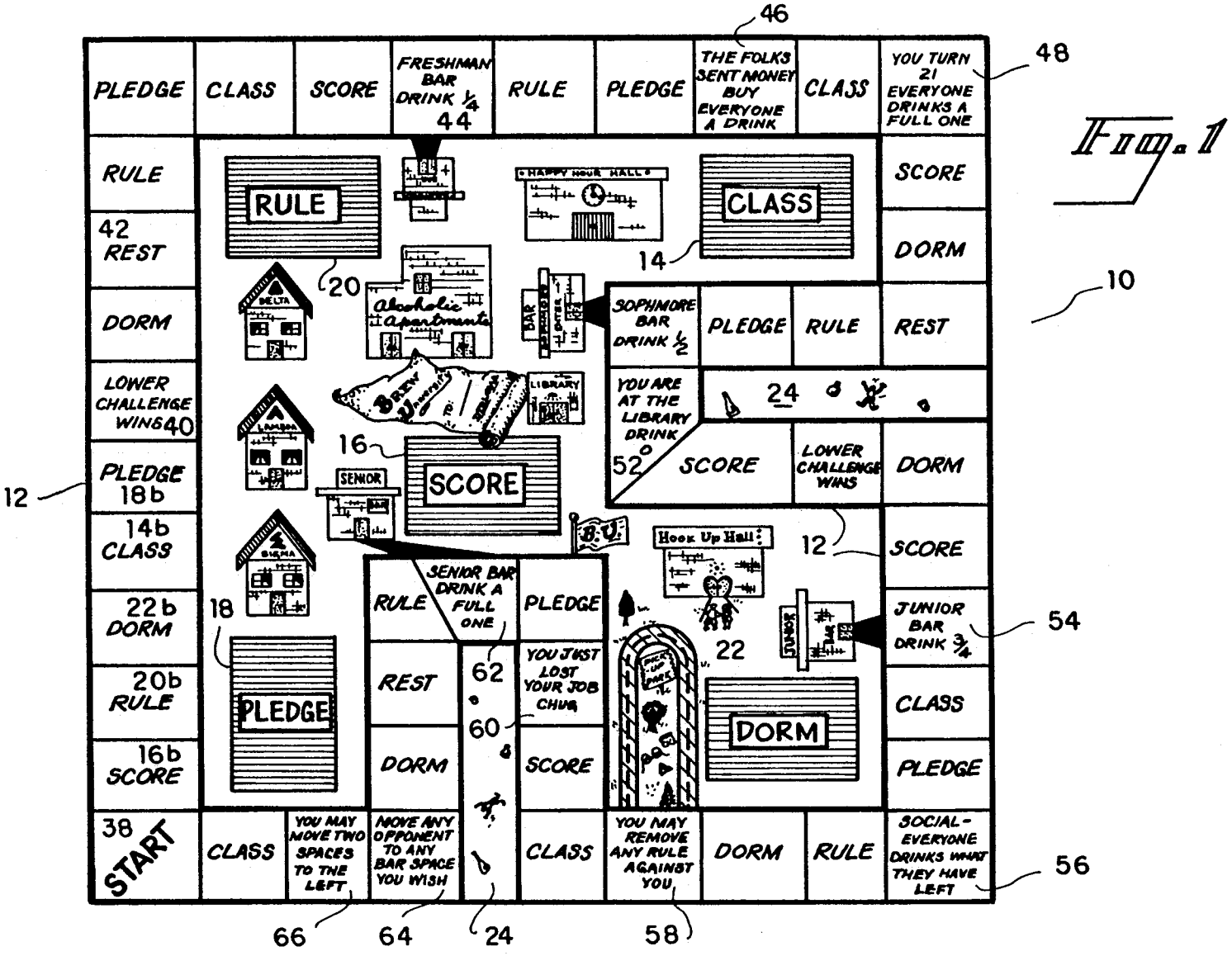
Fig. 1
10
12
14
16
18
20
22
24
38
40
42
44
46
48
52
54
56
58
60
62
64
66
START
YOU TURN 21 EVERYONE DRINKS A FULL ONE
THE FOLKS SENT MONEY BUY EVERYONE A DRINK
FRESHMAN BAR DRINK ¼
SOPHMORE BAR DRINK ½
YOU ARE AT THE LIBRARY DRINK
JUNIOR BAR DRINK ¾
SENIOR BAR DRINK A FULL ONE
YOU JUST LOST YOUR JOB CHUG
YOU MAY REMOVE ANY RULE AGAINST YOU
MOVE ANY OPPONENT TO ANY BAR SPACE YOU WISH
YOU MAY MOVE TWO SPACES TO THE LEFT
SOCIAL - EVERYONE DRINKS WHAT THEY HAVE LEFT
LOWER CHALLENGE WINS
CLASS
PLEDGE
RULE
SCORE
DORM
REST
Hoot Up Hall!
HAPPY HOUR HALL
BAR
LIBRARY
SENIOR Hey Pal, you Failed History Again!.....
How about finishing what's in your glass!

Nibble on the ear of any opponent you want to ___.

You can't curse!

METHOD OF PLAYING A BOARD GAME OF COLLEGE SOCIAL LIFE

FIELD OF THE INVENTION

This invention relates generally to board games and more particularly to a board game placing emphasis on the various social and extacurricular activities commonly associated with college life.

BACKGROUND OF THE INVENTION

The present invention relates to two fundamental interests of the typical person: First, the need or desire for recreation and entertainment, and second, the desire or interest the average person has in higher education. As is well known, a substantial percentage of persons living in the United States have experienced at least some college education, and a person with at least some college background is generally looked upon more favorably by society than persons without such an educational background. This phenomenon has led to widespread interest in the higher educational environment.

This widespread interest in higher education of course extends far beyond the relatively narrow academic field itself to encompass virtually all of college life in general, especially various extracurricular social activities. Many popular articles, books and movies have been produced which describe either factual or frictional on and off campus social activities which might be enjoyed by a college student, an example being the well known movie "Animal House."

While some games, including board games, have been produced which simulate the academic world, they are primarily intended to be educational in nature and fail to accommodate the interest of the general public in the social activities which surround the college academic community. Other games have been produced which provide for pure entertainment, emphasizing some aspect of our culture or society, such as social drinking. However, the inventor is aware of no such game which combines these two phenomena of U.S. society, i.e. a game primarily relating to the lighter, non academic side of higher education, particularly one which also places emphasis on social drinking and/or other physical activities during the course of play.

The need arises for a board game which emphasizes the humorous social side of college or university life rather than the academic side. Rather than a relatively serious emphasis on facts and academic knowledge, the game should be a relatively light and humorous approach to the extracurricular, non-academic side of college and/or university life. The game should be simple and easy to play, not requiring any particular knowledge or skill on the part of the players, and provide a relatively non competitive entertaining experience for all involved. Emphasis should be placed on various physical activities, such as social drinking (not necessarily limited to alcoholic beverages), to further lighten the play of the game.

DESCRIPTION OF THE RELATED ART

As noted above, various board games have been developed which relate to either the academic side of higher education or to other social aspects of life. An example is Martin U.S. Pat. No. 4,065,131, which relates primarily to the academic aspects of higher education. While this game is a light and somewhat humorous representation of the subject, very little of the game is directed toward extracurricular activities such as social drinking, an activity commonly perceived to be of great interest to college and university students and which is emphasized in the present invention. The apparatus and method of play of this game are also somewhat different from that of the present invention.

Reker, Jr. U.S. Pat. No. 4,368,889 discloses a board game relating to the humorous aspects of the educational experience for both teachers and pupils. This game, however, is directed toward grade school levels rather than higher levels of education and as such, no emphasis is placed upon various aspects of the present invention such as relationships between the sexes and social drinking. Furthermore, as with other generally related games of which the inventor is aware, the apparatus and method of play are somewhat different than that of the present invention.

Still other games relating to social drinking in particular are known in the art, such as the games of "Chug - A - Lug" and "Passout." In these games, no reference is made to any other aspect of college or university life, nor do these games relate to any particular environment. The entire object and method of play of these games is strictly directed toward drinking, unlike the present invention which, while directed to a great extent toward that activity, is not limited strictly to that activity but provides for other activities and actions relating to the non-academic college or university environment.

None of the above noted patents, either singly or in combination, are seen to disclose the specific construction and method of play disclosed by the present invention.

SUMMARY OF THE INVENTION

By the present invention, an improved board game directed toward various non-academic, extracurricular aspects of the college or university environment is disclosed.

Accordingly, one of the objects of the present invention is to provide an improved board game in which the rules of play require various physical actions to be performed by the players.

Another of the objects of the present invention is to provide a board game in which one of the physical actions required is the drinking of a beverage, either alcoholic or non alcoholic.

Yet another of the objects of the present invention is to provide a board game in which another of the physical actions required relates to a member of the opposite sex.

Still another of the objects of the present invention is to provide a board game in which a convoluted path around the perimeter of the board is used for travel of the playing pieces, each lap of the board representing an academic period of time, such as a college quarter, semester or year.

An additional object of the present invention is to provide a board game in which the winner may be determined as the first player or team to complete a predetermined number of laps of the board, the number of laps representing the completion of a college education, post graduate degree or the like.

A further object of the present invention is to provide a board game in which the winner may be determined as the player or team which completes the greatest number of laps of the board within a predetermined time period.

Yet another object of the present invention is to provide a board game in which provision is made for the implementation of some of the rules of the game to be operable only on certain individual players or teams at certain times during the course of play.

With these and other objects in view which will more readily appear as the nature of the invention is better understood, the invention consists in the novel construction and method of play hereinafter more fully described, illustrated and claimed with reference being made to the attached drawings.

BRIEF DESCRIPTION OF THE DRAWINGS

FIG. 1 is a view of the game board of the present invention, showing the convoluted path of play around the board perimeter, provision for cards to be drawn during the course of play and other features.

Similar reference characters designate corresponding parts throughout the several figures of the drawings.

DESCRIPTION OF THE PREFERRED EMBODIMENT

Figure 2A:
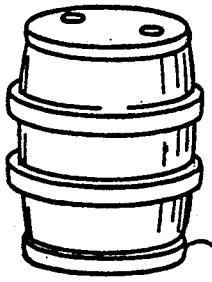
FIGS. 2A through 2F are perspective views of the various position markers to be used by the players or teams during the course of play.
Figure 2B:
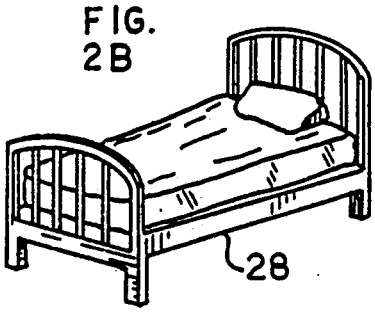
Figure 2C:
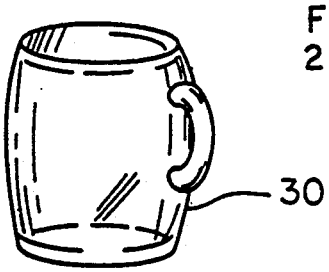
Figure 2D:
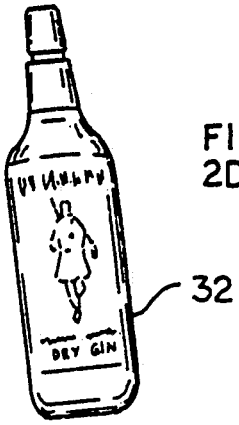
Figure 2E:
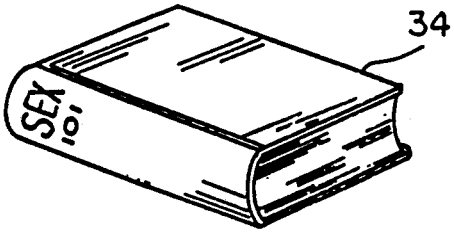
Figure 2F:
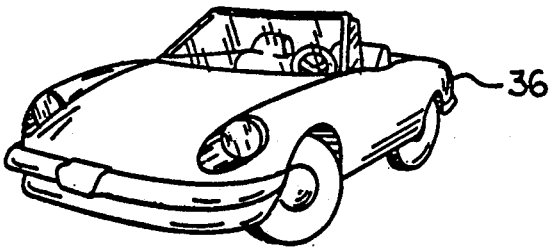
Figures 3, 4A, 4B, 4C:
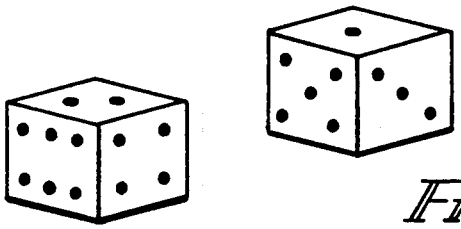
FIG. 3 illustrates two dice to be used during the course of play.
FIGS. 4A through 4C illustrate examples of a Class card, a Score card, and a Rule card, respectively.

Referring now to the drawings, particularly FIG. 1, the present invention will be seen to relate to a board game directed toward extracurricular aspects of higher education and incorporating physical actions by the players or teams during the course of play. The game board 10 basically comprises a playing path 12 located on the perimeter of the board 10 and spaces 14 through 22 for stacks of various types of cards **14*a* through 22*a*, listed in Tables 1 through 5, used during the course of play. Path 12 may have one or more convolutions 24 in order to provide for a longer playing path and therefore more variety in the play of the game. Playing pieces 26 through 36 as shown in FIGS. 2A through 2F are also used as position or location markers for players as they travel path 12 during the course of the game. A single die, FIG. 3, is used by the players or teams during the course of play in order to determine movement and position of the playing pieces 26 through 36** during the course of the game. The die is of the standard cubical configuration, with each of the six sides containing a number of dots or marks from one through six, as is well known in the art.

Path 12 begins at the corner 38 of the board 10 marked "START" and proceeds in a generally clockwise direction around the perimeter of the board 10. Path 12 is divided into a plurality of generally rectangular or otherwise geometrically shaped areas, each of which is marked with a word **14*b* through 22*b* which indicates which stack of cards 14*a* through 22*a* from which to draw a card 14*a* through 22*a*. Other areas 40 through 66 provide other instructions to be followed by any players or teams which may land on those areas 40 through 66**.

"CLASS" cards **14*a* generally designate the passage or failure of various generally fictional college or university courses and the corresponding action required by the player or team who draws such a card 14*a***. The text of these cards is listed in Table 1 below:

TABLE 1

Class Cards (1) Congratulations, you've passed Creative Accounting 407! Give out three drinks.
(2) Hey, Pal, you failed history again! How about finishing what's in your glass!
(3) Congratulations, you've passed Aerobics 099! Give out three drinks.
(4) Congratulations, you've passed Advanced Basket Weaving! Give out five drinks.
(5) Congratulations, you've pass Sex Education 101! Give out three drinks.
(6) Congratulations, you've passed Wine Tasting 099! Give out four drinks.
(7) Congratulations, you've passed Music Appreciation! Give out two drinks.
(8) Congratulations, you've passed Time and Space! Give out one half CHUG.
(9) Guess what? You've failed Calculus 429! DRINK.
(10) You hooked up with your Psychology professor and (he) (she) still failed you! Read the Kama Sutra and how about a three quarter DRINK!

"SCORE" cards **16*a*** generally designate any physical action to be performed with an opposing player or members of an opposing team. The text of these cards is listed in Table 2 below:

TABLE 2

Score Cards (1) Find a ticklish spot on the closest opponent of the opposite sex to your right.
(2) Give your best pick up line to the person you'd most like to hook up with after the game.
(3) Wink to the person you would most like to ravish at the end of the game.
(4) Rub the thigh of the closest opponent of the opposite sex on your right.
(5) Touch the closest opponent of the opposite sex to your left below the waist.
(6) Rub noses with the closest opponent of the opposite sex to your right.
(7) Touch the closest opponent of the opposite sex to your left above the waist.
(8) Kiss the closest opponent of the opposite sex on the cheek.
(9) Kiss any opponent of your choice on the lips.
(10) Nibble on the ear of any opponent you wish.

"PLEDGE" cards **18*a*** represent various fraternities or sororities which may be found on a college or university campus. Each card represents a given fraternity or sorority and provides for the action to be taken by a player or team drawing that card. The text of these cards is listed in Table 3 below:

TABLE 3

Pledge Cards (1) You want to be a Sigma? Drink a full one! (Sigmas are drinkers.)
(2) You want to be a Zeta? Zetas love that warm last sip—find the cup with the least and drink it with a SMILE.
(3) You want to be a Lambda? Lambdas are sick! Drink your drink and the drink of the person to the right!

(4) You want to be a Theta? Thetas are individuals. Drink whatever quantity you prefer.
(5) You want to be a Delta? Deltas don't think you have to drink to have a good time. Drink nothing.
(6) You want to be a Gamma? Gammas are average drinkers—drink one half.
(7) You want to be an Iota? Iotas are above average drinkers—drink three quarters.
(8) You want to be a Beta? Betas are below average drinkers—drink one quarter.
(9) You want to be an Alpha? Alphas are social drinkers—take a casual sip.
(10) You want to be an Omega? You're a legacy. Give out a Drink!

"RULE" cards 20a describe certain specific rules which apply only to the player or team who draws that specific card. The given rule must be obeyed by that player or team during the time the rule is in effect, as provided below in the description of the play of the game. The text of these cards is listed in Table 4 below:

TABLE 4

Rule Cards (1) You can't say any numbers.
(2) You can't touch your body below the waist.
(3) You can't point at anyone or any object.
(4) You can't say "drink," "drank" or "drunk."
(5) Each time you land on a space marked "REST" you take two drinks.
(6) You can't curse!
(7) Before you take any specified "Drink" you must say, "1, 2, 3, I am (we are) a lightweight(s)"!
(8) You must hold your drink in your left hand.
(9) You can't call anyone by their first name.
(10) You can't say "yes" or "no."

"DORM" cards 22a briefly describe scenarios which may occur between members of the opposite sex, generally in the dorm environment. The cards are each divided into two sections, one section describing a situation in which a male may be victimized or favored and the other describing a situation in which a female may be victimized or favored. These two sections are accordingly labeled for Guys and for Girls. However, each of these two sections on any one card require the same action to be taken by the person or team drawing the card, whether that person be male or female. The text of these cards is listed in Table 5 below:

TABLE 5

| | DORM CARDS | |
|---|---|---|
| (1) | GUYS | GIRLS |
| | Premature ejaculator! | He was (and still is) a virgin! |
| | ----DRINK TWO---- | |
| (2) | GUYS | GIRLS |
| | This girl was buying last year's worst lines! | You laughed in his face after his smoothest line! |
| | ----GIVE OUT TWO DRINKS---- | |
| (3) | GUYS | GIRLS |
| | Nine months later your phone rings! | He discovers that you're not a true blonde! |
| | ----DRINK ONE HALF---- | |
| (4) | GUYS | GIRLS |
| | Should have carded her. The relationship did not work out! | He passed out! |
| | ----DRINK TWO---- | |
| (5) | GUYS | GIRLS |
| | You tested negative! | You were three weeks late, but you got it! |
| | ----GIVE OUT FOUR DRINKS---- | |

TABLE 5-continued

| | | |
|---|---|---|
| (6) | GUYS | GIRLS |
| | You got double teamed! | You hooked up with the quarterback! |
| | ----GIVE OUT THREE DRINKS---- | |
| (7) | GUYS | GIRLS |
| | She slapped you and said, "I'm not that kind of girl"! | You blew him off. TEASE! |
| | ----DRINK TWO---- | |
| (8) | GUYS | GIRLS |
| | You passed out. | Your relationship with him is not working out |
| | ----DRINK ONE QUARTER---- | |
| (9) | GUYS | GIRLS |
| | You got nailed after hours by the Resident Advisor. | He found a strange pair of shoes underneath your bed. |
| | ----DRINK THREE---- | |
| (10) | GUYS | GIRLS |
| | She went to the ladies room and you met her roommate! | He was Mr. Right! |
| | ----GIVE OUT THREE DRINKS---- | |

The drinks to be taken or given out according to the instructions on the above cards 14a through 22a as listed in Tables One through Five, as well as those drinks to be taken or given out according to other instructions in areas 40 through 66 of the board 10, are not necessarily quantities related to a full glass. Rather, they may be any set quantity agreed upon by all players prior to the beginning of the game. Thus, the terms "drink a full one" or "chug," for example, need not necessarily mean that a full glass or container be consumed at that turn by that player but that whatever amount agreed upon by all players or teams prior to the beginning of the game be consumed according to the instructions.

Just as the quantities of beverage consumed are arbitrarily agreed upon by players prior to the beginning of the game, there is no rule specifying any particular type of beverage to be consumed during the course of the game. Thus, while the various instructions of cards 14a through 22a and of the playing path 12 of the game may imply that alcoholic beverages are to be consumed, the type of beverage, be it alcoholic or non alcoholic, is left to the discretion of the player, players or teams involved.

The game may be played by from two to six individual players, or alternatively by from two to six teams, each team comprising any practical number of players. When teams are playing, each member of a given team must also perform whatever actions are required to be performed by the individual player acting for that team on a given turn. If during the course of the game a special rule is applied to a given player, that rule is considered to apply to all players who are also members of that player's team.

To begin the game, each player or team selects one of the position markers 26 through 36. The player or team selecting the "keg" marker 26 plays first. If the selection of the position markers 26 through 36 cannot be mutually agreed upon by all players or teams, the die used during the course of play (of the pair as shown in FIG. 3) may be used to determine order of play and/or selection of position markers 26 through 36, with the player or team tossing the highest number on the die selecting the "keg" marker or piece and playing first. The player or team tossing the next highest number may select the next available marker 28 through 36 of their choice, and so forth through the remaining number of players or teams. Ties may be broken by the tied players or teams tossing the die again until the tie is broken. The order of play is determined from the position of the player or team using the "keg" marker 26, with play by subsequent players or teams proceeding in a clockwise order around the board from the "keg" player or team, as those subsequent players or teams are positioned around the board.

Each player or team begins the game by placing their markers 26 through 36 on the corner 38 designated as "start." The player or team using the "keg" marker 26 plays first, tossing the die and moving the "keg" marker 26 the appropriate number of spaces on the playing path 12 as indicated by the die. Should the player or team land on a space marked "score" **16*b*, "rule" 20*b*, "dorm" 22*b*, "class" 14*b*, or "pledge" 18*b* that player must draw a card 14*a* through 22*a* from the appropriate stack, read it aloud to all other participants of the game, and perform whatever action may be required by that card 14*a* through 22*a*. If teams are playing, each member of the team of the player drawing the card 14*a* through 22*a* must also perform whatever action is required by the card 14*a* through 22*a***.

Should the player or team land on a "rule" space **20*b*, the player or team drawing the "rule" card 20*a* as required, must then read the rule contained on the rule card 20*a* aloud to the other players or teams, and immediately return that drawn rule card 20*a* to the bottom of the stack. A listing of rules contained on rule cards 20*a* is provided in Table 4. The only way by which a rule may be removed is by landing on space 58 of the playing path 12**, "you may remove any rule against you," thus allowing the player or team to remove any one rule that may be in effect against them at that time, as they so choose.

A one drink penalty is provided for the breaking of any rule by any player or team. In order for the penalty to be enforced, an opponent must detect the rule being broken and verbally announce the detection of the broken rule. If that accusing player or team is correct, the player or team which has broken the rule must take one drink. If the accusing player or team is incorrect, the accusing player or team must take one drink. No provision is made for a written record of rules in effect against various players or teams at any given time, as the discussion of whichever rule or rules may be in effect or removed against any given team(s) or player(s) tends to enliven the play of the game and adds to the enjoyment. However, such a written record may be made if those persons playing the game so desire.

Should a player or team land on a "lower challenge wins" space 40, that player or team may challenge any other player or team they desire. The challenge is made by the challenging player or team and the challenged player or team each tossing the die. The lowest number tossed by either the challenging or the challenged player or team wins the challenge, and the losing player or team is then required to take the number of drinks as indicated by the number tossed on their die during the challenge.

During the course of the game a player or team may land on a "rest" space 42. This space requires no action on the part of the player or team landing on that space; they may merely rest upon that space until their turn comes up again, neither providing nor taking any drink or drinks, except in the cases of rule violations by any player or team or a challenge against the resting player or team by another player or team as described above.

Other possibilities are provided by various spaces 44 through 56 and 60 through 66, as described in Table 6 below:

TABLE 6

| OTHER NON CARD SPACES | |
|---|---|
| REFERENCE NUMBER | DESCRIPTION AND ACTION |
| 44 | Freshman Bar, Drink One Quarter |
| 46 | The Folks Sent Money, Buy Everyone a Drink |
| 48 | You Turn 21, Everyone Drinks a Full One |
| 50 | Sophomore Bar, Drink One Half |
| 52 | You Are At the Library, Drink 0 |
| 54 | Junior Bar, Drink Three Quarters |
| 56 | Social - Everyone Drinks What They Have left |
| 60 | You Just Lost Your Job - Drink |
| 62 | Senior Bar, Drink a Full One |
| 64 | Move Any opponent to Any "Bar" Space You Wish (i.e., Spaces 44, 50, 54, or 62. The player or team moved is considered to have moved clockwise around the board 10 to arrive at the "Bar" space as required by this play.) |
| 66 | You may move two spaces to the left. (This play places the player on the "start" corner 38, completing a lap of the board.) |

The play of the game continues in the manner described above, with each player or team playing in consecutive turn by tossing the die, moving their playing piece 26 through 36 the appropriate number of spaces along the playing path 12 as indicated by the die, and performing whatever action is indicated by the instructions on whichever space they land upon.

The completion of the game may be determined in several ways. Each lap of the game board 10 is considered to be the completion of one school "year," or alternatively may be considered as some other period of time related to the academic calendar, such as a quarter, semester or the like. A complete game may be determined prior to starting by mutual agreement of the players or teams involved as to the level of "academic achievement" to be reached. For example, if one lap of the game board 10 is considered to be equivalent to a complete school year and the game is to represent the completion of four years of college, then four laps of the game board 10 will complete the game. The winning player or team will be the player or team first completing four laps of the game board 10 in this example. Additional play may be attained by simulating the completion of graduate work leading to a postgraduate degree such as a masters, doctorate, etc. A simple score sheet, not shown, may be used to keep track of the number of laps completed by each player or team.

If time is a factor in the play of the game, then the player or team which has completed the greatest number of laps of the board 10 or which has advanced farthest around the board 10 within the previously arranged time limit will be considered the winner of the game. This method of play, as well as the one described immediately below, has the advantage of requiring no scoresheet or other written record in order to keep track of the standing of the players or teams involved with the game.

It is to be understood that the present invention is not limited to the sole embodiment described above, but encompasses any and all embodiments within the scope of the following claims.

We claim:

1. A method of playing a board game representing various social and/or non-academic aspects of college or university life, involving various physical interactions between the players or teams of said game and the consumption of beverages by said players or said teams of said game according to the rules of said game, comprising;

selection of a first player or team and subsequent players or teams by chance means, said first player or team selecting a designated first playing piece, said subsequent players or teams selecting remaining playing pieces, said first and said subsequent players or teams placing said first and said remaining playing pieces upon the starting point of the playing path of the game board of said board game, said first and said subsequent players or teams in turn determining subsequent positions for said playing pieces within spaces along said playing path by chance means, following a first subset or second subset of instructions contained in said spaces as determined by said positions of said playing pieces upon said playing path, drawing a game card of the appropriate class as determined by said class of said second subset of said instructions, if said position of said playing piece corresponds with one of said classes of said second subset of said instructions upon said playing path, said cards containing instructions for one of the following: physical interaction between players, consumption of beverages, rules imposing a physical limitation on a player drawing the card, performing said physical interaction between said players or said teams, said consumption of said beverages by said players or said teams as required by said instructions and/or said game card, and/or abiding by any rule provided by a rule containing game card as required and appropriate according to said position of said playing piece upon said playing path, said first subset of instructions including removing any one of said rules for a particular player or team, and continuing said playing of said game in the above manner until the game is completed.

2. The method of play of claim 1 whereby;

the first of said players or teams completing a predetermined number of laps of said playing path of said game board thereby winning said game.

3. The method of play of claim 1 whereby;

said player or team completing the greatest number of laps of said playing path within a predetermined elapsed period of play thereby winning said game.

4. The method of play of claim 1, including:

challenging a particular player or team upon landing on one of said spaces of said first subset of instructions having a challenge indicated upon it;

utilizing said chance means to determine a loser, said loser consuming a quantity of beverage.

* * * * *